US009149850B2

(12) United States Patent
Iguchi et al.

(10) Patent No.: US 9,149,850 B2
(45) Date of Patent: Oct. 6, 2015

(54) ROLL FORMER FOR STEEL PLATE AND ROLL BENDING METHOD FOR STEEL PLATE USING SAME

(75) Inventors: Keinosuke Iguchi, Tokyo (JP); Hideyuki Nakamura, Tokyo (JP)

(73) Assignee: NIPPON STEEL & SUMITOMO METAL CORPORATION, Tokyon (JP)

( * ) Notice: Subject to any disclaimer, the term of this patent is extended or adjusted under 35 U.S.C. 154(b) by 1127 days.

(21) Appl. No.: 13/138,016

(22) PCT Filed: Dec. 25, 2009

(86) PCT No.: PCT/JP2009/071897

§ 371 (c)(1),
(2), (4) Date: Jun. 23, 2011

(87) PCT Pub. No.: WO2010/074345

PCT Pub. Date: Jul. 1, 2010

(65) Prior Publication Data

US 2012/0011913 A1 Jan. 19, 2012

(30) Foreign Application Priority Data

Dec. 26, 2008 (JP) ..... 2008-332489

(51) Int. Cl.
*B21D 5/08* (2006.01)
*B21D 5/12* (2006.01)

(52) U.S. Cl.
CPC ... *B21D 5/08* (2013.01); *B21D 5/12* (2013.01)

(58) Field of Classification Search
CPC ..... B21D 5/08; B21D 17/04; B21D 5/12; B21B 13/142; B21B 1/22; B21B 27/005; B21B 19/04; B21C 37/104
USPC ..... 72/365.2, 366.1, 368, 176, 177, 179, 72/181, 182, 252.5
See application file for complete search history.

(56) References Cited

U.S. PATENT DOCUMENTS 3,911,709 A * 10/1975 Randerath ..... 72/179
4,339,938 A 7/1982 Nakagawa et al.
4,460,118 A * 7/1984 Ataka et al. ..... 228/146

FOREIGN PATENT DOCUMENTS

| | | |
|---|---|---|
| CA | 1196231 | 11/1985 |
| DE | 2716940 | 2/1978 |
| DE | 2916928 | 11/1979 |
| DE | 3220029 | 1/1983 |
| DE | 3137858 | 7/1983 |

(Continued)

OTHER PUBLICATIONS

European Search Report dated Jun. 15, 2012, issued in corresponding European Application No. EP 09835124.

(Continued)

*Primary Examiner* — Shelley Self
*Assistant Examiner* — Lawrence Averick
(74) *Attorney, Agent, or Firm* — Kenyon & Kenyon LLP

(57) ABSTRACT

A roll former for steel plate (3) which enables edge corner deformation of steel plate edges (4) to be avoided, that is, a roll former for steel plate comprised of a top roll (1) and a bottom roll (2), the roll former for steel plate characterized by forming convex curved parts (5) having a bending direction opposite to a bending direction of the steel plate (3) in regions of the bottom roll (2), which forms the outer side of the steel plate (3), which contact the steel plate edges (4).

5 Claims, 11 Drawing Sheets

(56) References Cited

FOREIGN PATENT DOCUMENTS

| | | |
|---|---|---|
| DE | 4410105 | 9/1995 |
| DE | 69926406 | 5/2006 |
| EP | 1169149 | 7/2005 |
| EP | 2134482 | 6/2010 |
| GB | 1557855 | 12/1979 |
| JP | 57-195531 | 12/1982 |
| JP | 3-180213 | 8/1991 |
| JP | 6-126336 | 5/1994 |
| WO | WO2008/110132 | 9/2008 |

OTHER PUBLICATIONS

International Search Report dated Apr. 6, 2010 issued in corresponding PCT Application No. PCT/JP2009/071897.

Jun-ichi Kokado et al., "On the forming Load and the Forming Torque in Forming a Groove with Wide Flanges by Cold Roll Forming," Memoirs of the Faculty of Engineering Kyoto University, vol. XXXVII, 1975, pp. 10-27, Kyoto, Japan.

* cited by examiner

PRIOR ART

PRIOR ART

PRIOR ART

PRIOR ART

PRIOR ART

ROLL FORMER FOR STEEL PLATE AND ROLL BENDING METHOD FOR STEEL PLATE USING SAME

This application is a national stage application of International Application No. PCT/JP2009/071897, filed 25 Dec. 2009, which claims priority to Japanese Application No. 2008-332489, filed 26 Dec. 2008, each of which is incorporated by reference in its entirety.

TECHNICAL FIELD

The present invention relates to a roll former for steel plate and to a roll bending method for steel plate using the same, more particularly relates to a roll former for steel plate and a roll bending method for steel plate using the same which are suitable for production of thick-walled tubes such as cylinder tubes.

BACKGROUND ART

As a method of production of steel pipe, the method of using a large number of rolls to gradually bend steel plate to finally form it into a round cross-sectional shape, then welding together the end faces is being widely employed.

This bending process is roughly divided into a first breakdown process and a second fin pass process. In the breakdown process, major bending is performed.

Rolling bending of steel plate is performed by pressing steel plate between a top roll and a bottom roll. The steel plate is fed over the bottom roll which shapes the outer side of the steel plate and is bent by the top roll which shapes the inner side of the steel plate.

As shown in FIG. 1, both the top roll 1 and the bottom roll 2 usually have a roll caliber with a curvature along a bending direction of the steel plate 3.

As shown in FIG. 2, the bottom roll 2 sometimes also has a straight roll caliber.

When roll bending thick-gauge steel plate, in both the case of FIG. 1 and FIG. 2, at the time of starting bending, the steel plate edges 4 contact the bottom roll 2 in a line (or by points). If a downward pressing force is applied, the steel plate edges 4 unavoidably crush.

Once edge corner deformation occurs, restoration is impossible.

When the drawing action in the fin pass process shown in FIG. 3A is insufficient, if the steel plate edges 4 are made to abut in a pipe shape, as shown in FIG. 3B, a Y-shaped joint will be formed resulting in a welding defect.

If sufficient drawing was applied in the fin pass process, as shown in FIG. 3C, the edges will locally increase in thickness and the circularity of the inside circumference of the pipe will sometimes fall.

This problem becomes pronounced when t/D, where the plate thickness of the steel pipe is "t" and the diameter is D, is 0.06 or more.

To avoid this problem, in PLT 1, as shown in FIG. 4A or FIG. 4B, the method is proposed of pre-bending the steel plate edges 4 in advance by pre-bend-use rolls so that in the breakdown process shown in FIG. 4C, the steel plate edges 4 are not bent.

However, even if using pre-bend-use rolls, at the time of start of bending, no matter what is done, a certain extent of edge corner deformation is unavoidable. Further, before the breakdown process, it is then necessary to install a pre-bend-use stand, so the problem of inviting a larger size of the facilities remains.

CITATION LIST

Patent Literature

PLT 1: Japanese Patent Publication (A) No. 57-195531

SUMMARY OF INVENTION

Technical Problem

An object of the present invention is to provide a roll former for steel plate and a roll bending method for steel plate using the same which can avoid edge corner deformation of the steel plate edges without use of a pre-bend-use stand even when producing steel pipe with a t/D of 0.06 or more.

Solution to Problem

The inventors studied in depth the shapes of rolls of roll former for steel plate and edge corner deformation of steel plate edges and made the present invention from the obtained findings. The present invention has as its gist the following.

(1) A roll former for steel plate having a top roll and a bottom roll, characterized by comprising convex curved parts having a bending direction opposite to a bending direction of the steel plate in zone of contact between edge of the steel plate and the bottom roll which forms the outer side of the steel plate.

(2) The roll former for steel plate according to the above (1), characterized by comprosing straight or concave curvatures in that parts of the bottom roll other than the zone of contact between edge of the steel plate and the bottom roll.

(3) The roll former for steel plate according to the above (1) or (2), wherein the concave curved parts have a radius of curvature R of at least $0.15t^2$ wherein "t" is a thickness of the steel plate.

(4) The roll former for steel plate according to the above (1) or (2), wherein the bottom roll, which forms the outer side of the steel plate, is split into left and right parts with a distance between them which can be adjusted in accordance with the thickness and width of the steel plate.

(5) The roll former for steel plate according to the above (3), wherein the bottom roll, which forms the outer side of the steel plate, is split into left and right parts with a distance between them which can be adjusted in accordance with the thickness and width of the steel plate.

(6) A method of roll forming method for steel plate characterized by using a roll former for steel plate according to (1) or (2), and roll forming the steel plate while preventing edge corner deformation of the steel plate edges.

(7) A method of roll forming for steel plate characterized by using a roll former for steel plate according to (3), and roll forming the steel plate while preventing edge corner deformation of the steel plate edges.

(8) A method of roll forming for steel plate characterized by using a roll former for steel plate according to (4), and roll forming the steel plate while preventing edge corner deformation of the steel plate edges.

Advantageous Effects of Invention

In the roll former for steel plate of the present invention, the regions of the bottom roll, which forms the outer side of the steel plate, which contact the steel plate edges have a convex curvature opposite in direction to the bending direction, so when the steel plate is pressed by the top roll, the steel plate edges will curve along the convex curved parts in an opposite direction to the bending direction and not crush.

If using the roll former for steel plate of the present invention, it is possible to produce steel pipe with a t/D of 0.06 or more without allowing edge corner deformation of the steel pipe edges.

Further, there is no need to use a pre-bend-use stand either, so no larger size of the facilities is invited either.

The parts of the bottom roll other than the regions where it contacts the steel plate edges do not have any effect on edge corner deformation of the steel plate edges, so may be given a straight shape or concave curvature.

If the radius of curvature R of the curved parts 5 of the bottom roll is too small, dents and defects may be caused in the steel plate 3 contacted, but by making the radius of curvature R $0.15t^2$ or more, it is possible to eliminate this concern.

When using the same line to produce steel pipe which is the same in size, but different in plate thickness, even if the steel pipe is the same in outside diameter, it is different in plate width, so the regions of the bottom roll which contact the steel plate edges also differ. In that case as well, if making it possible to adjust the distance between the split left and right parts of the bottom roll in accordance with the thickness of the steel plate, it is possible to use the same roll former to handle different pipe dimensions.

DESCRIPTION OF EMBODIMENTS

Below, preferred embodiments of the present invention will be explained.

Figure 1:
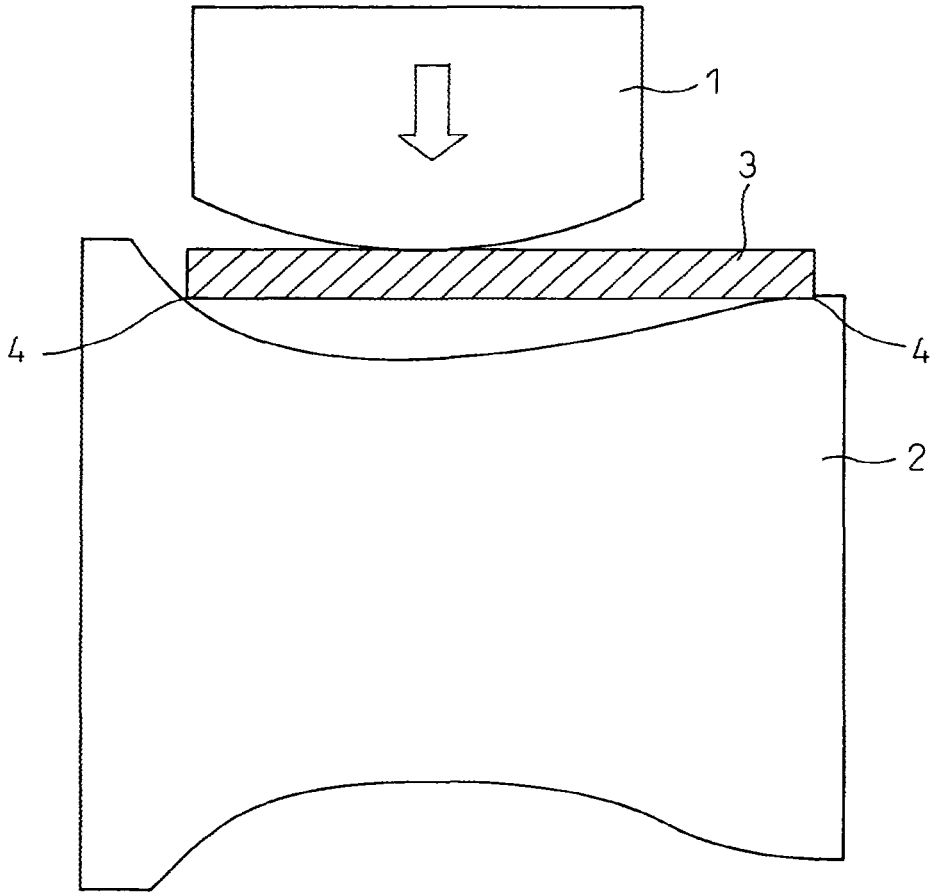
FIG. 1 is a view schematically showing a roll former for steel plate according to the prior art.
Figure 2:
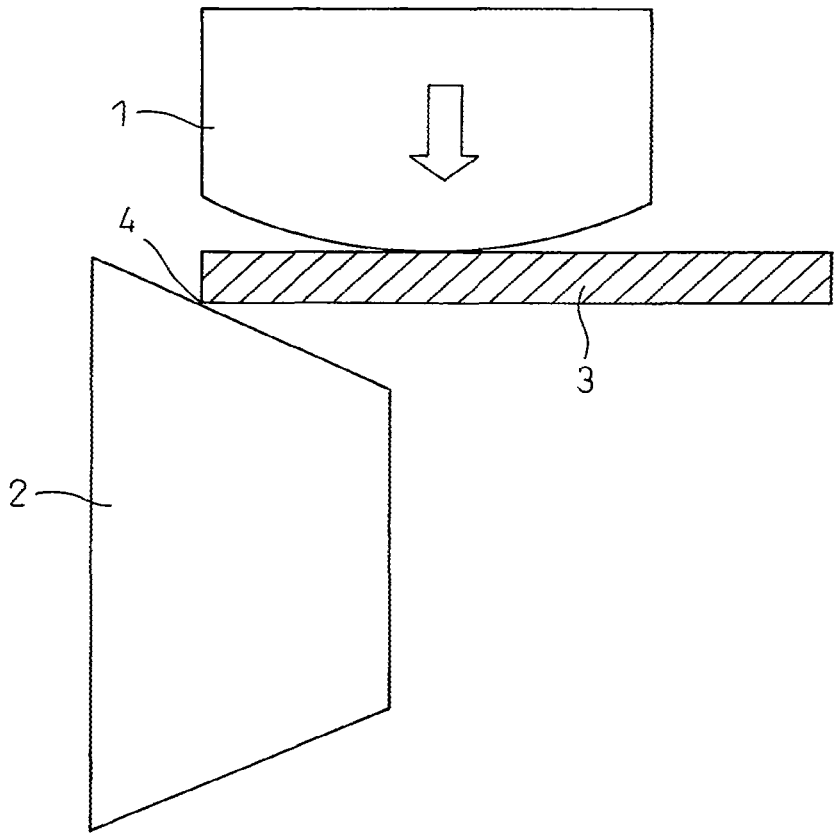
FIG. 2 is a view schematically showing a roll former for steel plate according to the prior art.
Figure 3A:
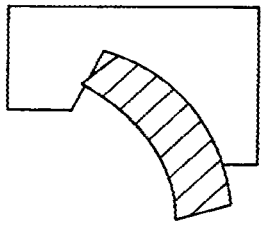
FIG. 3A is a view schematically showing a fin pass process.
Figure 3B:
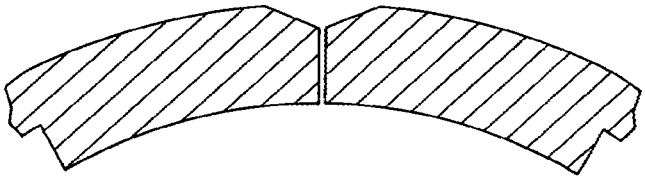
PRIOR ART Fig.3B
FIG. 3B is a view schematically showing a welding defect resulting from a Y-joint.
Figure 3C:
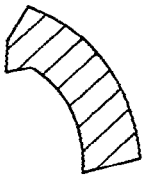
PRIOR ART Fig.3C
FIG. 3C is a view schematically showing a local increase in thickness of a steel plate edge.
Figure 4A:
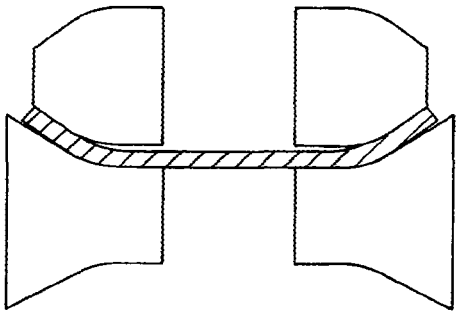
FIG. 4A is a view schematically showing pre-bending of steel plate edges by pre-bend-use rolls according to the prior art.
Figure 4B:
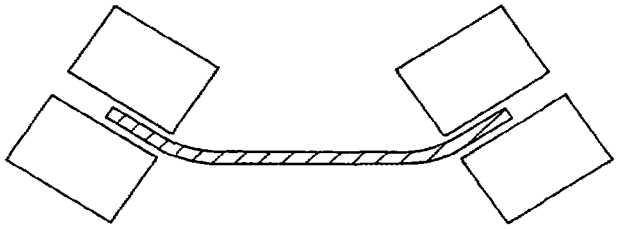
PRIOR ART Fig. 4B
FIG. 4B is a view schematically showing pre-bending of steel plate edges by pre-bend-use rolls according to the prior art.
Figure 4C:
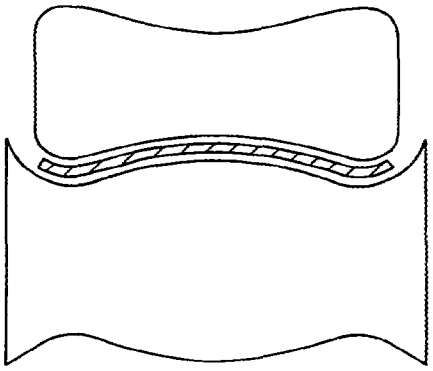
PRIOR ART Fig. 4C
FIG. 4C is a view schematically showing a breakdown process according to the prior art.
Figure 5:
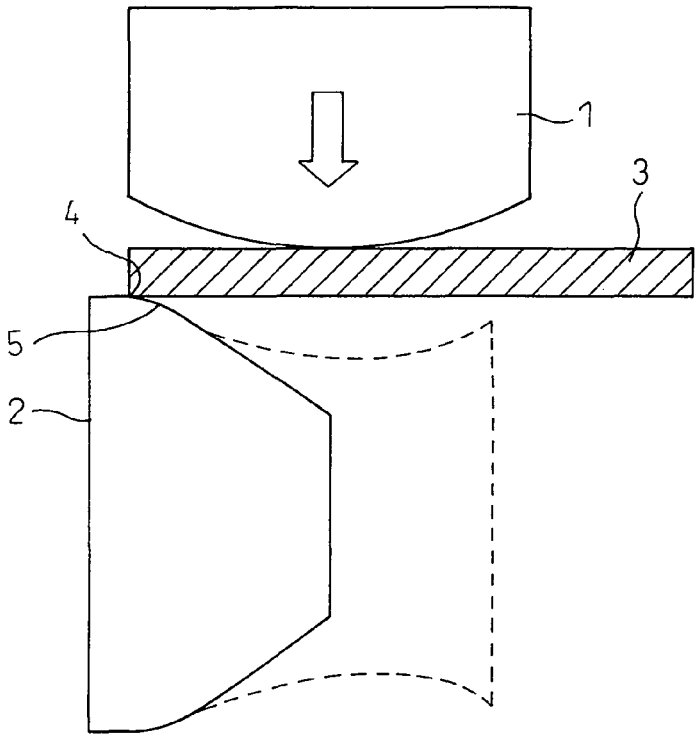
FIG. 5 is a view schematically showing a roll former for steel plate according to the present invention.

FIG. 5 is a view showing principal parts of the present invention. A steel plate 3 is fed between a top roll 1 and a bottom roll 2, pressed in an arrow direction, and roll bent.

In the present invention, only the first stand at which roll bending is started for the purpose of preventing edge corner deformation of the steel plate edges 4 at the time of start of bending is shown.

At the succeeding stands, almost no edge corner deformation of the steel plate edges 4 occurs, so at the succeeding stands, it is also possible to use rolls which have a roll caliber similar to those of the past.

The top roll 1 and the bottom roll 2 have mating roll calibers in the bending direction. The bottom roll 1 which forms the outer side of the steel plate 3 has a concave roll caliber, while the top roll 1 which forms the inner side has a convex roll caliber.

However, with this shape, the steel plate edges 4 crush.

Therefore, in the present invention, as shown in FIG. 5, the regions of the bottom roll 2 which contact the steel plate edges 4 are provided with convex curved parts 5 in an opposite direction to the bending direction.

Figure 6:
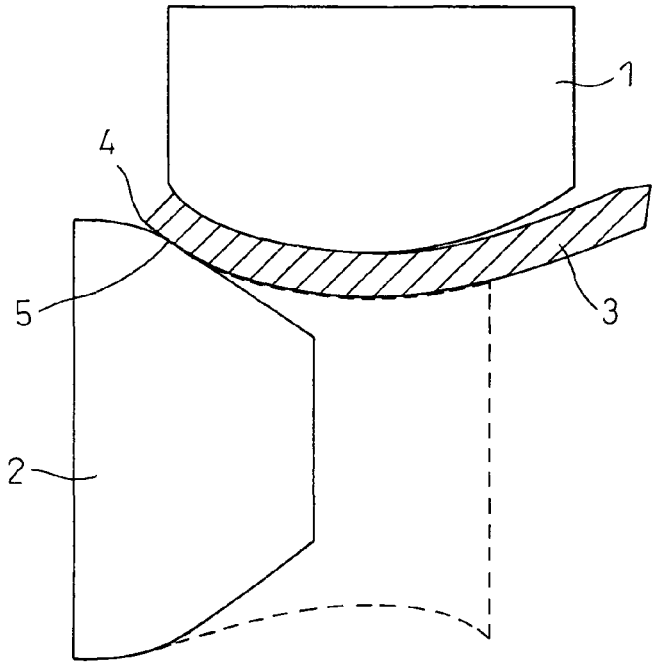
FIG. 6 is a view schematically showing a time when a roll former for steel plate according to the present invention is used to bend steel plate.

Due to this, if the top roll 1 applies a downward pressing force to the steel plate 3, the steel plate edges 4 do not have the plate shaped right angles such as shown in FIG. 5, but contact the bottom roll planarly and slide in along the curvatures 5 such as shown in FIG. 6 along with the progress in bending.

The parts of the bottom roll 2 other than the edges may be straight in shape or may be provided with curved parts such as shown by the broken line in FIG. 5.

The steel plate 3 is bent upward, but the steel plate edges 4 rise up only slightly from the curved parts 5 of the bottom roll 2, so edge corner deformation does not occur.

The parts of the bottom roll 2 other than the regions which contact the steel plate edges 4 may be made straight in shape or recessed in roll caliber.

Below, preferable conditions of the convex curved parts 5 in the present invention will be explained.

Figure 7A:
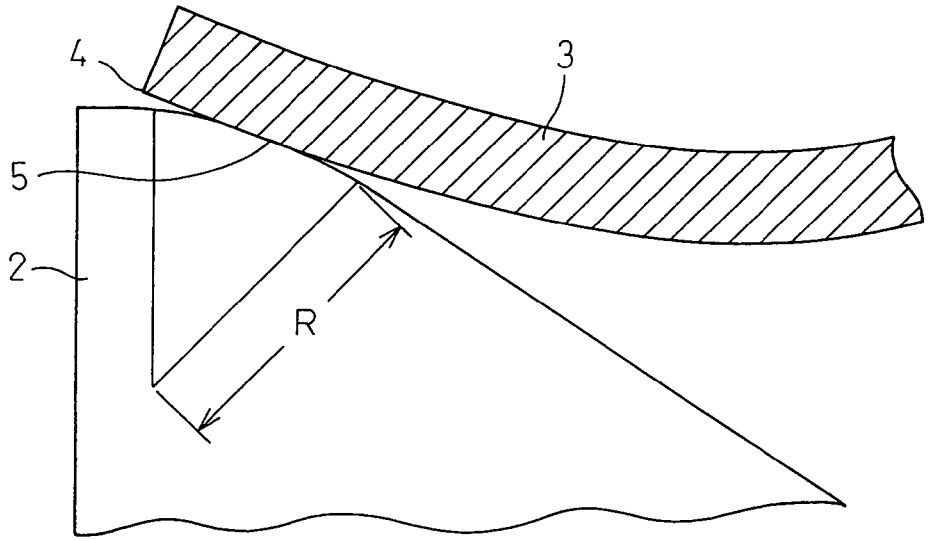
FIG. 7A is a view showing a lower limit value of a radius of curvature R of a curved part of the bottom roll.
Figure 7B:
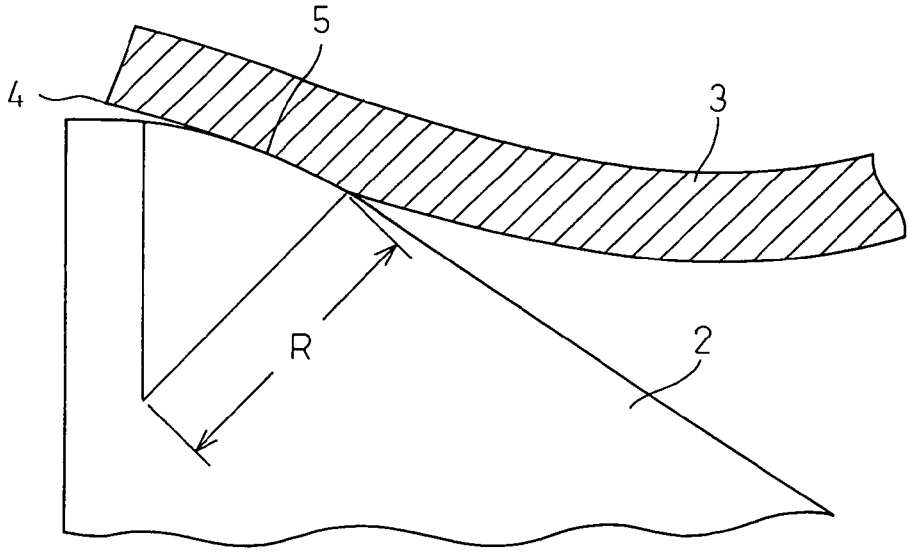
FIG. 7B is a view showing a lower limit value of a radius of curvature R of a curved part of the bottom roll.

In the present invention, if starting the bending from the state of FIG. 7A, as shown in FIG. 7B, the curved parts 5 are pushed against the bottom surface of the steel plate 3, so if the radius of curvature R of the curved parts 5 is too small, dents and defects are liable to occur at the contacting parts.

Figure 8:
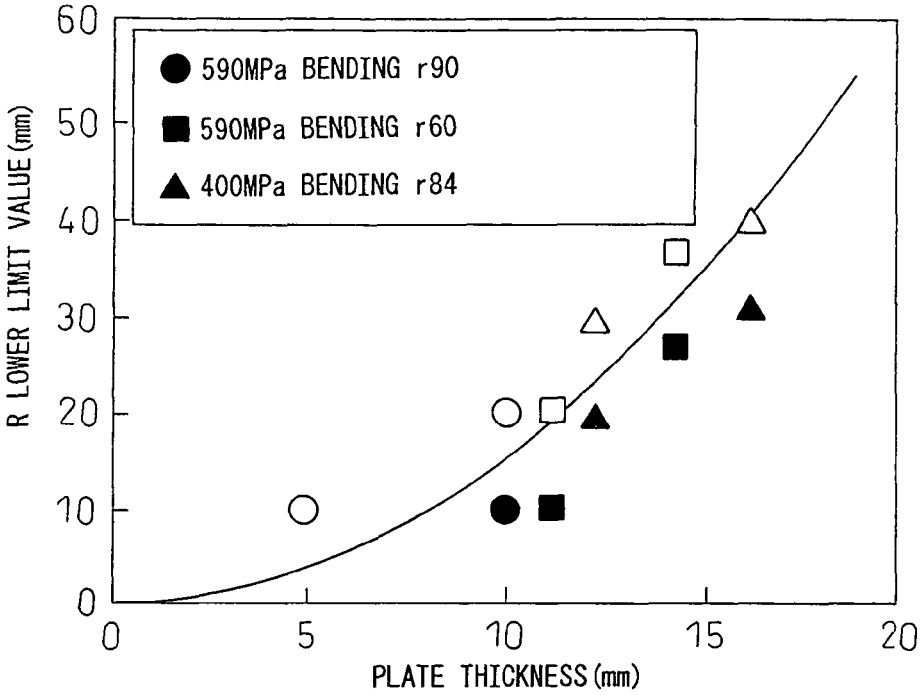
FIG. 8 is a view showing a relationship between a plate thickness and a lower limit value of the radius of curvature R.

From the results of study by experiments by the inventors, it was learned that the lower limit value of the radius of curvature R where dents occur does not depend on the material strength and can be approximated, as shown in the graph of FIG. 8, as a function of the square of the plate thickness "t", that is, $0.15t^2$.

In FIG. 8, the white marks mean no dents, while the black marks mean there are dents. From the reasons, it is preferable that $R \geq 0.15t^2$.

The reason which the limit R of occurrence of dents becomes a function of $t^2$ is as follows.

The moment which is required for bending a steel plate as a whole is $t^2\sigma y/4$. The pressing force for generating this bending moment also becomes maximum at the time of shaping the edges, so is free of the influence of the bending radius and is proportional to $t^2\sigma y/4$.

The yield strength against dents of the material may be considered to be proportional to $\sigma y$, so the limit of occurrence of dents becomes proportional to $t^2$.

The upper limit of the radius of curvature R of the curved parts 5 will be explained next.

Figure 9:
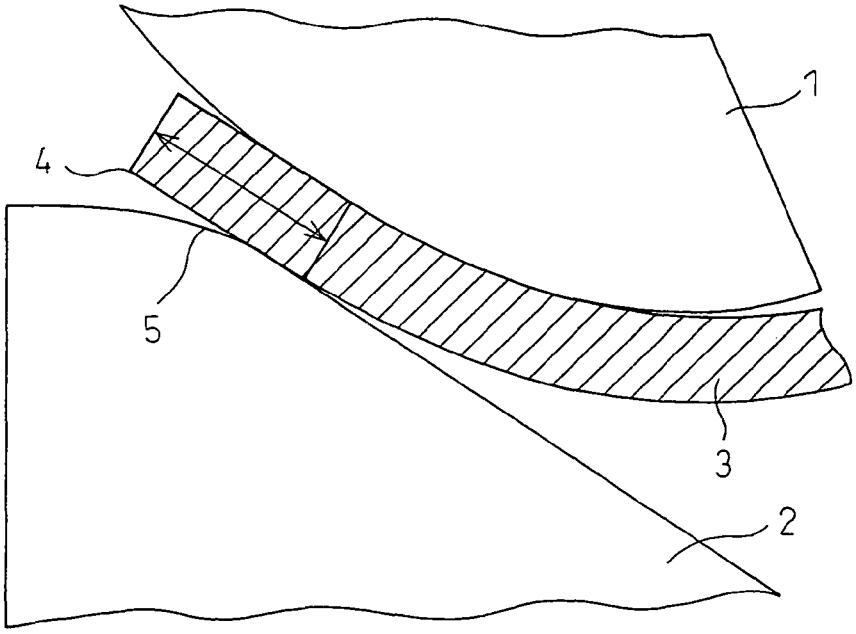
FIG. 9 is a view showing an upper limit value of a radius of curvature R of a curved part of the bottom roll.

As shown in FIG. 9, at the parts of the bottom roll 2 of the curved parts 5 (part shown by arrow in FIG. 9), it is not possible to bend the steel plate 3 in the bending direction, so if the radius of curvature R becomes too large, the unbent parts end up increasing, so this is not preferable.

This point will be studied in detail.

Figure 10:
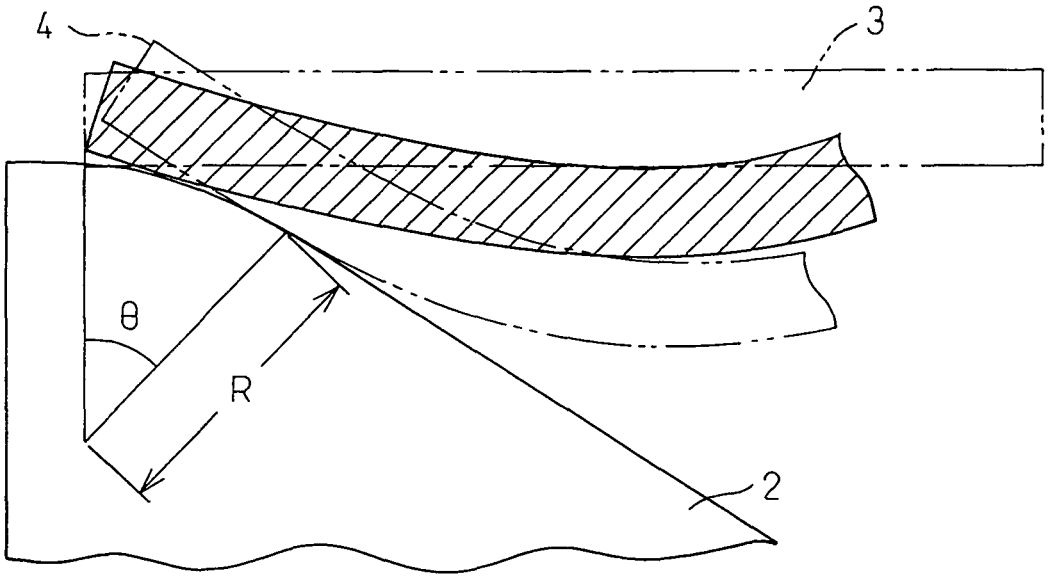
FIG. 10 is a view showing movement of a steel plate edge due to only rotation.

When rolling is used to bend steel plate 3, if slip does not occur at the contacting parts of the steel plate 3 and the bottom roll 2, the steel plate edges 4, as shown in FIG. 10, will move due to rotation of the curved parts 5. The length which is not bent if considering only rotation becomes $2\pi R\theta/360$ where the roll angle of the curved part 5 is $\theta$.

Figure 11:
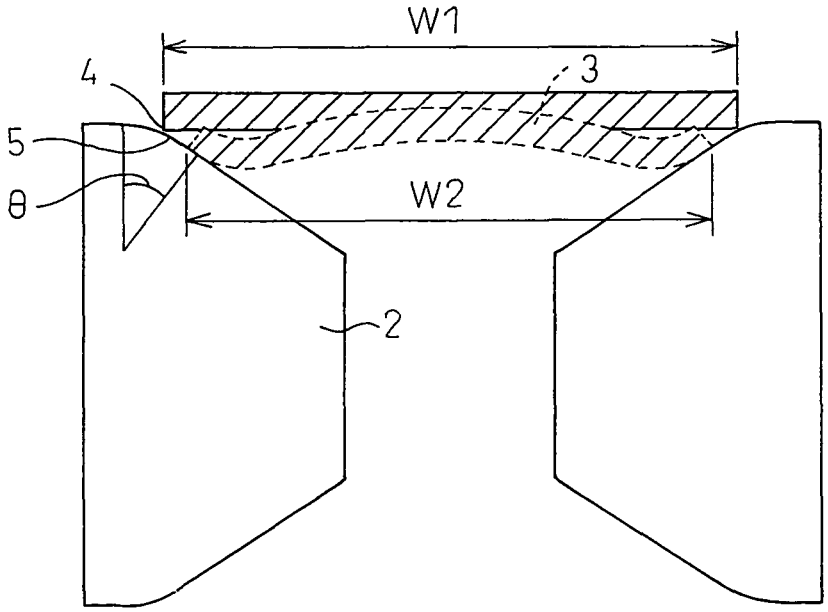
FIG. 11 is a view showing movement of steel plate edges due to slip.

As shown in FIG. 11, by bending the steel plate 3, the distance between the edges of the steel plate changes from W1 to W2, so the steel plate edges 4 move due to the slip due to the change in plate width as well. The steel plate after bending is shown by the broken line in FIG. 11.

This movement due to slip occurs along the roll angle $\theta$, so from the amount of change of plate width and the roll angle $\theta$, $(W1-W2)/\tan\theta$. This amount of slip has added to it the bending due to wrapping around the rolls.

Therefore, if subtracting, from the length to which bending is not applied in the case of considering only rotation, this amount due to slip, the final unbent length L is found to be $2\pi R\theta/360-(W1-W2)/\tan\theta$.

Figure 12:
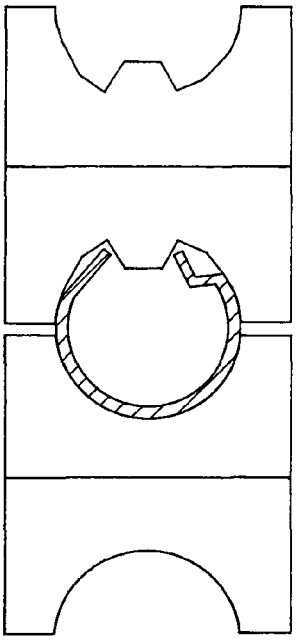
FIG. 12 is a view schematically showing fin pass rolls.

The straight part of the length L is shaped as shown in FIG. 12 in the succeeding fin pass process, but if the L is too long, problems such as edge buckling occur.

The length L, from operating experience, has to be $L\leq 2t$. If entering the above equation for calculation it is preferable that $R\leq((2t+(W1-W2)/\tan\theta)\times 360)/2\pi\theta$.

Summarizing the above, the radius of curvature R of the curved part 5 is preferably $$0.15t^2\leq R\leq((2t+(W1-W2)/\tan\theta)\times 360)/2\pi\theta.$$

In many production lines, the same rolls are used to produce steel pipes of the same outside diameters but different plate thicknesses. In this case, even if the outside diameters of the steel pipes are the same, the plate widths are different, so the regions of the bottom roll contacting the steel plate edges change.

Figure 13:
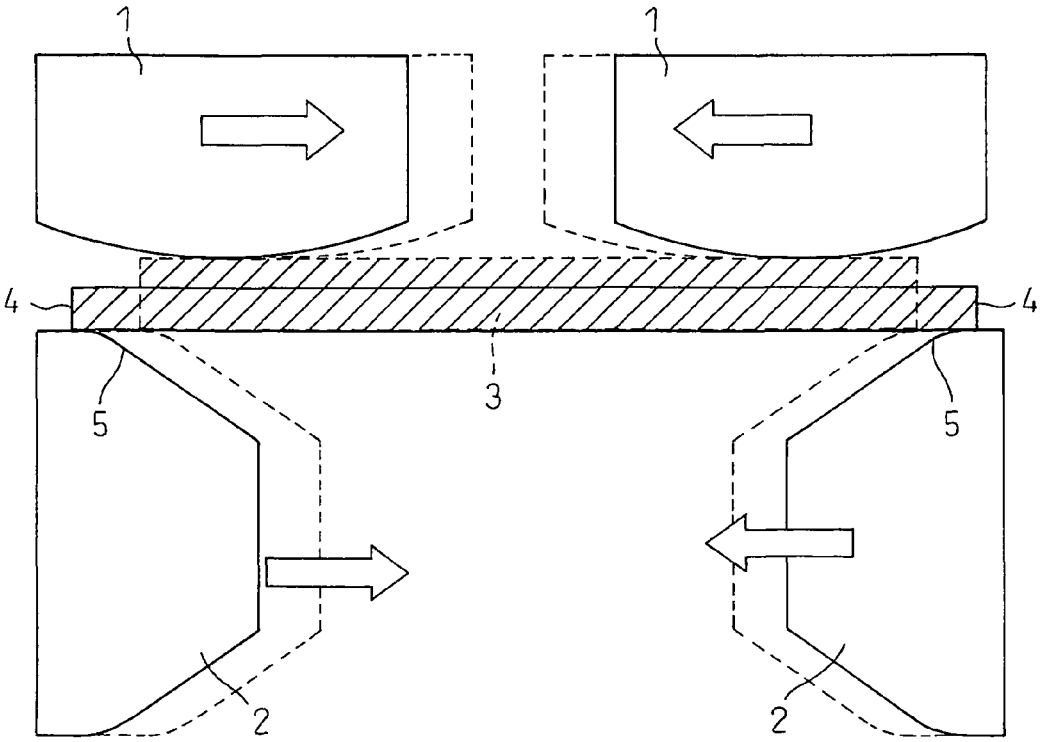
FIG. 13 is a view for explaining scaling of the bottom roll.

For this reason, as shown in FIG. 13, by splitting the bottom roll 2 into left and right parts and enabling adjustment of the distance between the split parts of the bottom roll in accordance with the thickness of the steel plate 3, it becomes possible to ensure that the steel plate edges 4 are constantly correctly in contact with the curved parts 5. Even when the plate width changes, it is sufficient to adjust the distance between the split parts of the bottom roll.

The broken line part of FIG. 13 shows the state where the plate thickness changes and the distances between the parts of the top roll and the bottom roll are adjusted.

EXAMPLES

Below, the present invention will be explained using detailed examples.

A single stand was used to roll the edges of steel plate having a thickness of 10 mm and a strength of 590 MPa. The edge corner deformations at the time of shaping for the case of using rolls according to the present invention and the case of using rolls according to the conventional case were compared.

Figure 14:
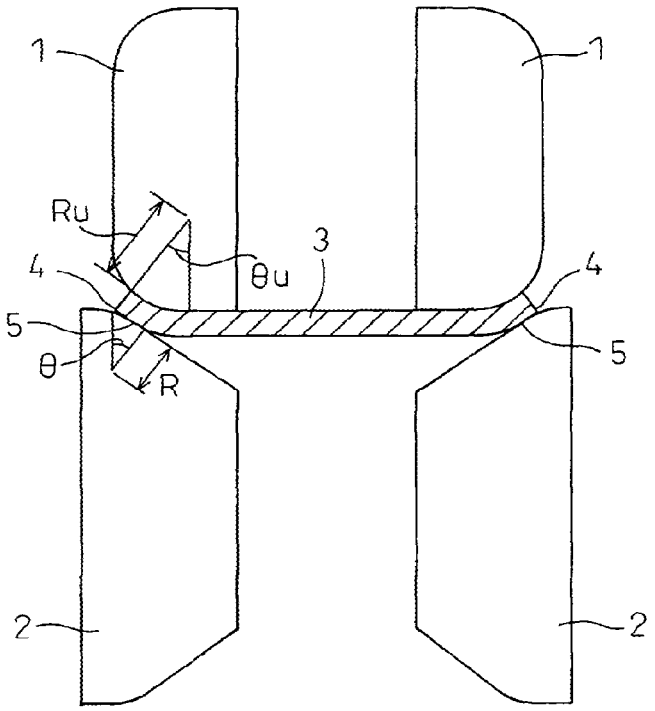
FIG. 14 is a view schematically showing rolls according to the present invention.

FIG. 14 is a schematic view of roll shapes according to the present invention. At the portions of the bottom roll contacting the steel plate edges, convex curved parts are formed with a radius of curvature R of 30 mm, a roll angle $\theta$ of 35°, and a bending direction opposite to the direction of bending of the steel plate. The rest of the parts are straight in shape. At portions of the top roll which bend the steel plate, convex curved parts are formed with a radius of curvature Ru of 50 mm and a roll angle $\theta u$ of 35°.

Figure 15:
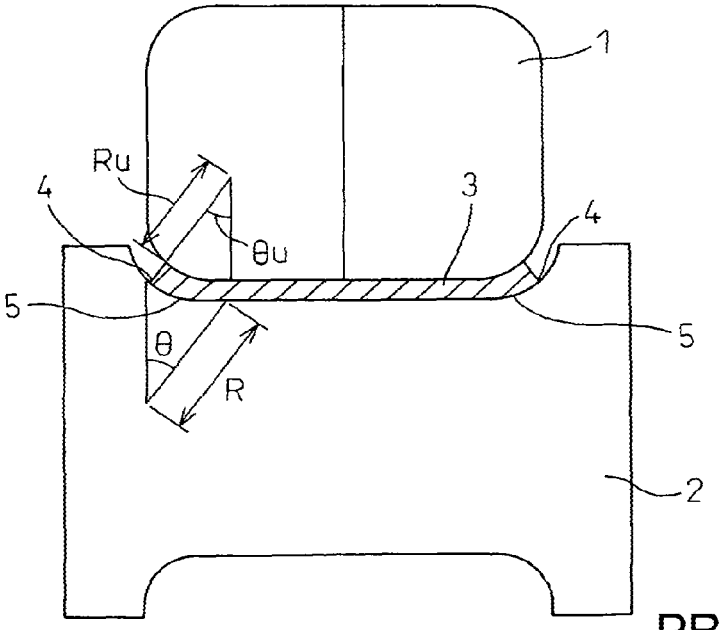
FIG. 15 is a view schematically showing rolls according to the prior art.

FIG. 15 is a schematic view showing the roll shapes of the conventional method used as a comparative example. The portions of the bottom roll bending the steel plate are formed with concave curved parts having directions of bending the same as the direction of bending of the steel plate. The corresponding portions of the top roll are formed with convex curved parts. The top roll has a radius of curvature Ru of 50 mm and a roll angle $\theta u$ of 35°, while the bottom roll has a radius of curvature R of 60 mm and a roll angle $\theta$ of 35°.

Figure 16:
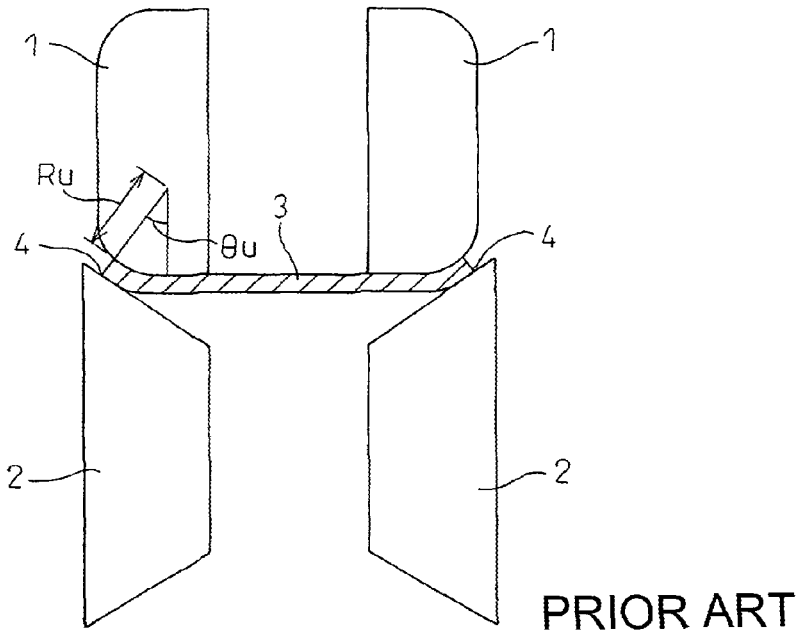
FIG. 16 is a view schematically showing rolls according to another prior art.

FIG. 16 is a schematic view showing the roll shapes of another conventional method used as a comparative example. The bottom roll is straight in shape with no curved parts. The portions of the top roll which bend the steel plate are formed with convex curved parts which have a radius of curvature Ru of 50 mm and have a roll angle $\theta u$ of 35°.

Figure 17:
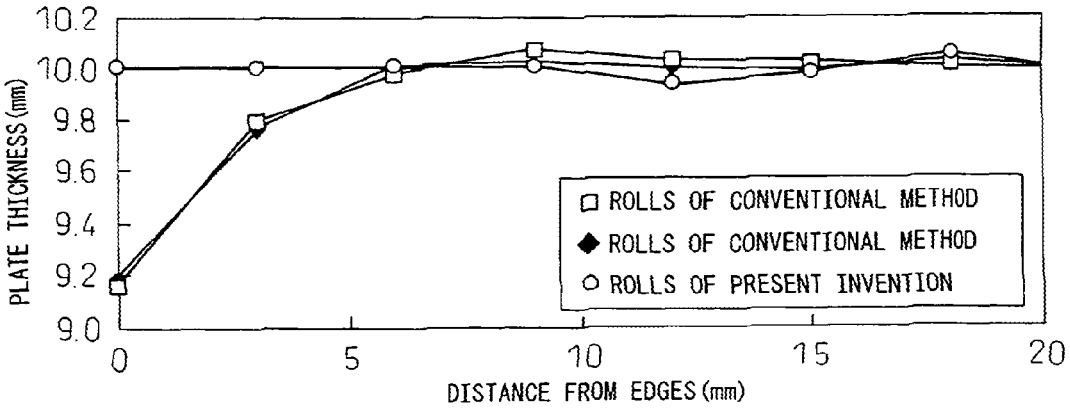
FIG. 17 is a view showing a distribution of plate thickness of steel plate edges.

FIG. 17 shows the plate thickness of the steel plate edges after using a single stand to bend the steel plate.

As shown in FIG. 17, it was confirmed that while the plate thickness fell 0.8 mm in the case of using the conventional method shown in FIG. 15 and FIG. 16, there is almost no change in the plate thickness in the case of using the rolls of the present invention shown in FIG. 14.

INDUSTRIAL APPLICABILITY

If using the roll former for steel plate of the present invention, it is possible to produce steel pipe with a t/D of 0.06 or more without allowing edge corner deformation of the steel pipe edges.

The present invention has a great industrial applicability in the ferrous metal industry, in particular in the production of thick-walled pipe such as cylinder tubes.

REFERENCE SIGNS LIST

1 top roll
2 bottom roll
3 steel plate
4 steel plate edges
5 curved part
R radius of curvature of curved part
$\theta$ roll angle
W1 distance between edges of steel plate before bending
W2 distance between edges of steel plate after bending

The invention claimed is:

1. A method of roll forming for a steel plate using a roll former for a steel plate, the roll former having a top roll and a bottom roll on which convex curved parts are formed, the method characterized in that the steel plate edges are located so as to contact the convex curved parts, the top roll applies a downward pressing force on the steel plate, the steel plate edges contact the bottom roll planarly, and the steel plate edges slide in along the convex curved parts along with the progress in bending, wherein the concave curved parts have a radius of curvature R of at most $((2t+(W1-W2)/\tan\theta)\times 360)/2\pi\theta$, wherein "t" is a thickness of the steel plate, "W1" is a distance between edges of the steel plate before bending, "W2" is a distance between edges of the steel plate after bending, and "θ" is a roll angle.

2. The method of roll forming for steel plate according to claim 1, wherein the bottom roll has straight or concave curvatures in other than the zone of contact between the steel plate edges and the bottom roll.

3. The method of roll forming for steel plate according to claim 1, wherein the concave curved parts have a radius of curvature R of at least $0.15t^2$ wherein "t" is a thickness of the steel plate.

4. The method of roll forming for steel plate according to claim 1, wherein the bottom roll is split into left and right parts with a distance between them, and the distance is adjusted in accordance with the thickness and width of the steel plate.

5. The method of roll forming for steel plate according to claim 1, wherein t/D is 0.06 or more wherein "t" is a thickness of the steel plate and "D" is a diameter of steel pipe after roll forming.

* * * * *